United States Patent [19]

Pippenger

[11] 4,076,462

[45] Feb. 28, 1978

[54] COMBINED DISTRIBUTOR AND BYPASS VALVE FOR FLUID ACTUATED PUMP OR MOTOR

[75] Inventor: John J. Pippenger, Acton, Mass.

[73] Assignee: W. H. Nichols Company, Waltham, Mass.

[21] Appl. No.: 708,638

[22] Filed: Jul. 26, 1976

[51] Int. Cl.[2] ..... F04B 49/08; F04C 1/06

[52] U.S. Cl. ..... 417/310; 418/61 B

[58] Field of Search ..... 418/61 R, 61 B, 132, 418/133; 417/310

[56] References Cited

U.S. PATENT DOCUMENTS

| | | | |
|---|---|---|---|
| 3,270,683 | 9/1966 | McDermott | 418/61 B |
| 3,658,450 | 4/1972 | Woodling | 418/61 B |
| 3,841,801 | 10/1974 | Sturlason et al. | 418/61 B |
| 3,880,554 | 4/1975 | Termansen et al. | 418/61 B |

*Primary Examiner*—Carlton R. Croyle
*Assistant Examiner*—Leonard Smith

[57] ABSTRACT

A fluid actuated device of the type wherein the controlled supply and discharge of fluid medium actuates a member for movement through an orbital path in which the flow of the fluid medium is controlled solely by a valve structure rotating in synchronism with a member rotatively driven by said orbitably moving member and which control selectively permits the supply of fluid medium to bypass the orbitably movable member.

15 Claims, 8 Drawing Figures

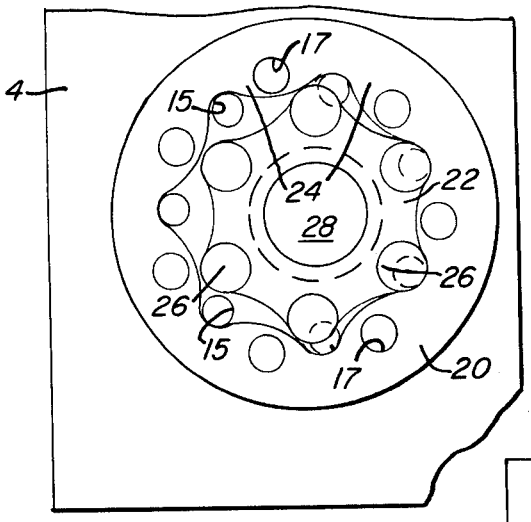
FIG. 3
FIG. 5
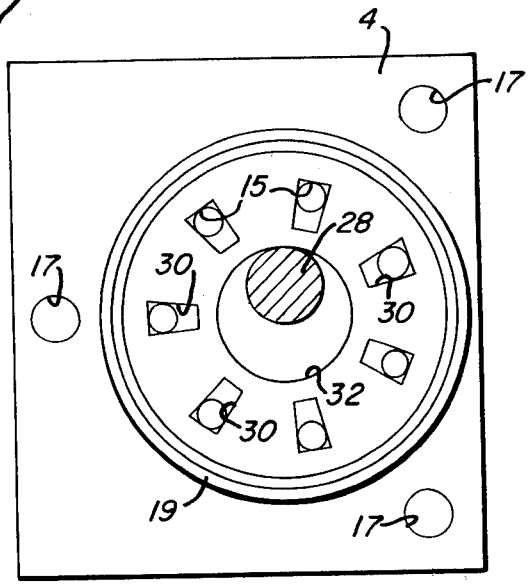
FIG. 4
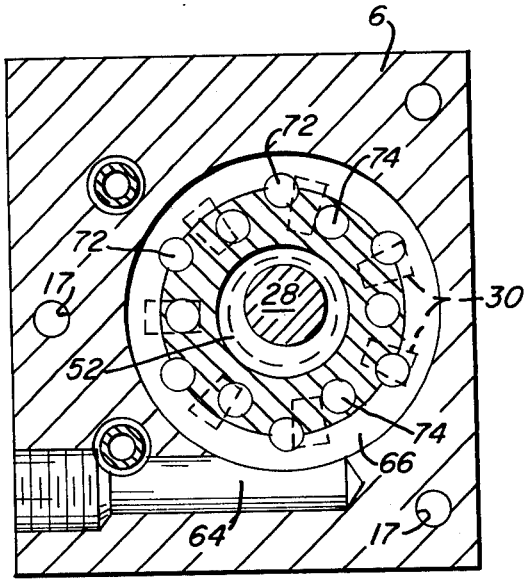

COMBINED DISTRIBUTOR AND BYPASS VALVE FOR FLUID ACTUATED PUMP OR MOTOR

BACKGROUND OF THE INVENTION

Fluid actuated devices utilizing an orbital member are well known and one type of such device is commonly referred to as orbit motors. Prior orbit motors have employed various structures to control the supply and discharge of fluid medium which have required a number of cooperable members to be precision machined to obtain the tolerances necessary to permit operation of the motor. With such precision components the prior motors have been limited to utilizing high quality lubricating fluids to obtain reasonable motor life. Further the output of such prior motors has been limited for a given set of components and different sets of precision components are required to obtain a range of power outputs for the orbit motor. Also various designs of such prior orbit motors have required that various portions of the enclosing housing and various internal components be exposed to the pressure of the supply fluid which due to the higher pressure involved has required that the housings and components be sectioned to withstand such higher pressure. Still other types of fluid actuated devices utilizing an orbital member such as pumps are well known and have the same disadvantages as set forth above.

SUMMARY OF THE INVENTION

The devices of this invention utilize a unitary valve structure to control the supply and discharge of actuating fluid to a fluid actuated device such as an orbit motor which, although a precision part, coacts with a valve plate such that it need not be machined to maintain precise fits with a plurality of components and avoids the many problems of multiple precision components such as cumulative tolerances. In addition various valve structures can be utilized in the same casing to control the fluid supply and discharge for various sizes of fluid devices whereby a number of devices having various outputs can be obtained at a minimum cost. With such single valve structure only a portion of the housing for the devices is subjected to the higher fluid supply pressure. Further the devices of this invention are provided with an hydraulically biased shiftable valve such that when the hydraulic bias is removed the valve shifts to permit the actuating or displaced fluid of such devices to circulate within the devices.

Accordingly, one object of this invention is to provide a new and improved fluid actuated device having a member movable through an orbital path in which a unitary rotary valve controls the supply and discharge of fluid to such member in cooperation with a stationary valve plate.

Another object of this invention is to provide a new and improved fluid actuated device having a member movable through an orbital path in which a unitary rotary valve for controlling the supply and discharge of fluid to such member is biased into engagement with a valve plate.

Still another object of this invention is to provide a new and improved fluid actuated device of the orbital motor type having an output drive portion thereof pressurized at a pressure substantially less than the pressure of the supply fluid.

A further object of this invention is to provide a new and improved fluid actuated device having a member movable through an orbital path in which a unitary valve for controlling the supply and discharge of fluid is selectively movable to provide a fluid bypass with respect to such member.

These, other and more specific objects of this invention will become more apparent upon consideration of the following detailed description of a presently preferred embodiment thereof with relation to the drawings thereof.

BRIEF DESCRIPTION OF THE DRAWINGS

FIG. 3 is a cross sectional view of the device as shown in FIG. 1 taken along line 3—3 thereof;

FIG. 4 is a cross sectional view of the device as shown in FIG. 1 taken along line 4—4 thereof;

FIG. 5 is a cross sectional view of the device as shown in FIG. 1 taken along line 5—5 thereof;

DESCRIPTION OF THE PREFERRED EMBODIMENT

Figure 1:
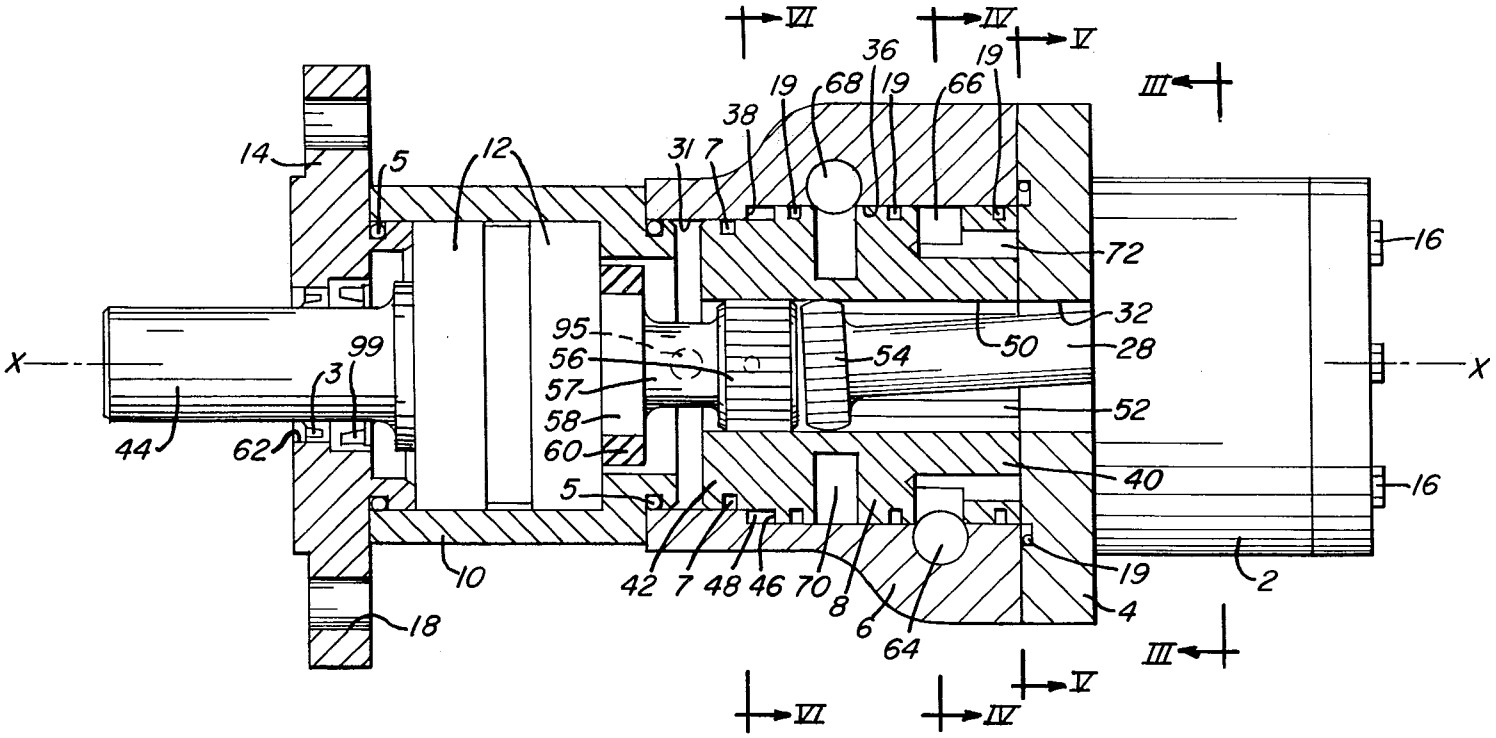
FIG. 1 is a partial side elevational and partial central longitudinal cross sectional view of a fluid actuated device constructed in accordance with the principles of this invention.

The presently preferred embodiment of a fluid actuated device of this invention comprises an orbital or orbit motor having, FIG. 1, a stationary casing 2 for a displacement set, a stationary valve plate 4, a stationary formed cylindrical casing 6 having a formed commutator valve 8 rotatable and axially shiftable therein, a stationary formed cylindrical casing extension 10 having a pair of bearings 12 rotatable therein and a stationary mounting plate 14. The stationary members 2, 4, 6, 10 and 14 form a rigid housing and are rigidly secured together in any suitable manner such as by means of threaded fasteners located as desired in a manner known to the art; however, to simplify the illustration of the invention only the heads of suitable bolts 16 extending axially from opposite ends of the motor 2 and plate 14 and various openings 17 cooperable with bolts 16 are shown. Such bolts 16 and openings 17 are spaced and located as desired to permit the entire assembly to be rigidly secured to the casing, housing or frame of a member, not shown, to be driven by the device of this invention.

The commutator valve 8 of this invention has various unique structured features for controlling, in conjunction with valve plate 4, the supply and discharge of fluid from a displacement set which displacement sets are well known in the art and, for the purposes of this invention, the displacement set illustrated and described herein may be of any suitable known structure. FIG. 3 illustrates a suitable displacement set consisting of a stator 20 and a rotor 22 having cooperable tooth forms 24 and 26 respectively. Such displacement sets can be considered generally as sequentially admitting pressurized fluid to adjacent chamber portions between the tooth forms 24 and 26 while simultaneously permitting discharge of fluid from other ones of such sequential chambers to provide a rotary motion to an elongated output shaft 28 having a driven end suitably secured, such as by being splined, to the rotor 22. The longitudinal axis of shaft 28 is coaxial with the center of rotor 22 such that the center of such inner end of shaft 28 and rotor 22 travel in the same orbital path with relation to the stator 20 as is known. Inasmuch as such displacement sets are well known in the art and do not, per se, constitute a part of this invention further description thereof can be obtained by reference to such known prior art.

As is also known, various forms of displacement sets are employed in orbit motors and pumps and for the purposes of better understanding this invention a displacement set for an orbit motor having seven passageways or ports 15 for receiving and discharging fluid to and from the chamber portions between the tooth forms 24 and 26 will be described with reference to the illustrated valve plate 4. As will become apparent hereinafter the central longitudinal axis or the geometric center of the stator 20 establishes the longitudinal central axis x—x of the device of this invention. Thus, as shown valve plate 4 has, FIG. 5, seven identical through ports 30 spaced uniformly radially outwardly from and uniformly circumferentially with respect to the central axis x—x. Ports 30 are, in cross section, in the form of a truncated planar cone with the smaller ends thereof being located closest to the axis x—x.

As shown casing 6 extends axially between the valve plate 4 and the casing extension 10 and is provided with a circular cross sectional stepped through bore 36 extending coaxially with respect to axis x—x. Bore 36 is of a uniform diameter for the major extent extending axially outwardly of valve plate 4 and has a uniform reduced diameter bore portion 31 for a lesser axial extent spaced axially from the valve plate 4 whereby an annular radially extending shoulder 38 is formed between such axial extents coaxial with the axis x—x. The commutator valve 8 extends axially from valve plate 4 within bore 36 and has a uniform external diameter axial extent 40 extending outwardly of the valve plate 4 and a reduced uniform external diameter axial extent 42 extending axially into the reduced diameter portion 31 of the casing 6. The major portion of the axial extent 42 is closely and rotatably received within the bore portion 31 and is of a length to provide adequate support to the inner end of an output shaft 44 hereinafter described. The axial extent 40 is closely and rotatably received within the larger diameter axial extent of the casing 6. In addition the axial extent 42 extends inwardly of the larger diameter portion of bore 36 to provide in conjunction with the axial extent 40 a radially outwardly extending annular shoulder 46 spaced, in the position shown, axially from shoulder 38 to form an annular axially extending chamber 48 therebetween. In practice a chamber 48 having an axial extent of one-fourth inch is satisfactory for this invention. The central axes of the axial extents 40 and 42 and the shoulder 46 are also coaxial with the axis x—x.

Valve 8 is also provided with a central elongated through bore 50 coaxial with axis x—x. In order that the valve 8 can properly control the supply and discharge of fluid from the displacement set it is necessary that the valve 8 and the shaft 28 rotate in unison. Accordingly, bore 50 has axially extending spline teeth 52 coaxial with axis x—x and the end of shaft 28 outwardly of the displacement set has a gear segment 54 having a tooth form to provide a universal joint type gear drive to valve 8 through teeth 52 as is known in the art. With such universal joint connection the orbital movement of the end of shaft 28 corresponding to the orbital movement of the rotor 22 rotatably drives the valve 8 around the axis x—x in synchronism with the gear segment 54. Accordingly, a central opening 32 is provided in plate 4 which opening 32 and bore 50 are each of a diameter with relation to the intermediate diameter of the shaft 28 to permit the shaft 28 to freely orbit therein.

With the assembly heretofore described various types of power output units can be driven which as illustrated is the elongated output shaft 44 having a gear segment 56 within the valve 8 with the teeth thereof cooperable with the spline teeth 52 so as to be rotatively driven thereby. Shaft 44 is coaxial with axis x—x and has an intermediate reduced diameter portion 57 extending outwardly from the gear segment 56 and an outwardly adjacent radially enlarged portion 58 which is formed to retain the roller bearings 12 thereon to rotatively support the central portion of the shaft 44 within the extension 10 in any suitable manner as is well known. A bearing retaining ring 60 is threadedly secured to the portion of the shaft 44 adjacent the reduced diameter portion 57 to permit axial adjustment of the bearings 12 as is known. Bearings 12 are of any suitable structure such as tapered bearings as is well known for such purposes. The outer portion of shaft 44 extends outwardly through a central opening 62 in mounting plate 14 to provide a drive to a device, not shown, to be driven by the device of this invention. It is to be noted that the annular surface of the casing 6 outermost from the casing 2 constitutes an interface between the drive of this invention and the power output structure incorporating shaft 44. Accordingly, to those skilled in the relevant art the power output structure can be of various forms as desired provided the power output device has a gear segment 56 as described.

As shown in FIG. 4, casing 6 is provided with a suitable fluid passageway or port 64 with the outer end being externally accessable and having suitable means such as threads to permit a hydraulic line, not shown, to be attached thereto. An inner portion of port 64 is open to an annular gallery or chamber 66 on the outer periphery of valve 8 with fluid communication existing therebetween in all relative positions of valve 8 and casing 6. Casing 6 is provided with a similar passageway or port 68 in constant fluid communication with an annular gallery or chamber 70 on the outer periphery of valve 8. Galleries 66 and 70 are spaced axially on valve 8 and for the purposes of this description the gallery 66 closest to the valve plate 4 will be described as the return or discharge fluid gallery and the gallery 70 furtherest from the valve plate 4 will be described as the supply fluid gallery. As shown, FIG. 4, gallery 66 is in fluid communication with six identical circular cross sectional ports 72 in casing 6 having centers, with respect to axis x—x, circumferentially spaced at 60° from each other and which ports 72 are located radially in valve plate 4 to be in fluid communication with the radially, with respect to axis x—x, outermost portions of ports 30 when valve 8 is rotated with respect to valve plate 4. Ports 30 have been shown in phantom in FIG. 4 to better illustrate such relationship. In a similar manner gallery 70 is in continuous fluid communication with six identical circular cross sectional ports 74 having centers on lines extending radially, with respect to axis x—x, which are spaced at 60° from each other and 30° from circumferentially adjacent ports 72. Ports 74 are located radially outwardly from the axis x—x to be in fluid communication with the radially innermost portion of the ports 30 when valve 8 is rotated with respect to valve plate 4. Ports 72 and 74 have their centers on concentric circles, respectively, coaxially with axis x—x. With such location of the ports 72 and 74 rotation of valve 8 sequentially supplies and discharges fluid to the differential set whereby the rotor 22 is rotated through its orbit in either one of opposite orbital directions as is known. The described location of ports 72 and 74 radially with respect to ports 30 is not critical and any suitable location to provide for operating the differential set can be employed; however, the particular location described is preferred to facilitate proper machining of the valve 8. In order to provide fluid isolation of the galleries 66 and 70 suitable peripheral continuous grooves are provided between galleries 66 and 70 and axially outwardly therefrom for receiving suitable dynamic O-ring or piston ring type seals 19 as is known. A similar O-ring seal 19 is provided in valve plate 4 to provide a fluid seal between the valve plate 4 and valve 8 radially outwardly of valve 8.

Figure 6:
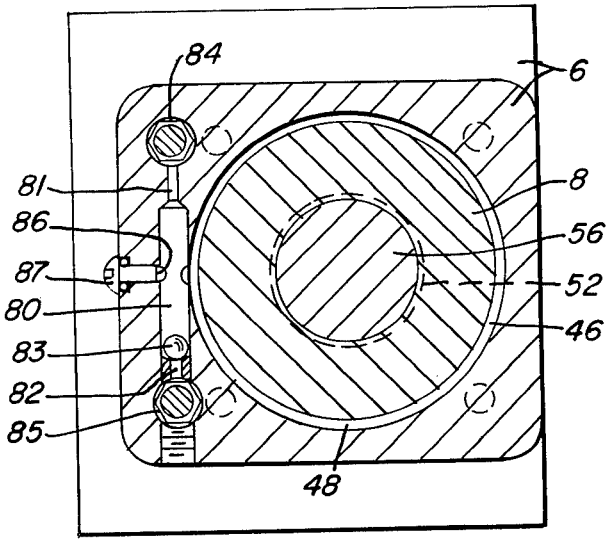
FIG. 6 is a cross sectional view of the device as shown in FIG. 1 taken along line 6—6 thereof.

Inasmuch as the supply and return fluid traverses the interface between valve 8 and valve plate 4 it is necessary to provide a positive fluid seal therebetween. Accordingly, the mating surfaces between valve 8 and valve plate 4 are precisely machined and high pressure fluid is directed into chamber 48 to bias valve 8 into engagement with valve plate 4 and provide such seal. As shown in FIG. 6 chamber 48 is in fluid communication at a portion of its outer periphery with an elongated passageway 80 within casing 6 having fluid communication with reduced diameter passageways 81, 82 extending outwardly from opposite ends thereof with the junctures between passageways 80 and passageways 81 and 82 being outwardly tapered towards passageway 80 to provide taper seats for a check valve ball 83. The other ends of passageways 81 and 82 are in fluid communication through passageways 84, 85 with the fluid ports 64 and 68 respectively whereby the passageway 80 is, as described hereinafter, in fluid communication with either of the ports 64 and 68. Chamber 48 of a radial extent to have a sufficient area upon which the supply fluid can be effective to bias the valve 8 as described and accordingly chamber 48 is of any suitable axial extent. In operation with the supply fluid entering through the passageways 84 fluid flows to passageway 81 into passageway 80 and is effective upon the valve ball 83 to move the valve ball 83 into engagement with the tapered seat at the end of passageway 82 so that the fluid communication of passageway 80 with the fluid return side is discontinued and the supply fluid in chamber 48 biases the valve 8 into axial engagement with the valve plate 4. Inasmuch as the displacement set can rotate in either of opposite directions, as described, the same seating of valve ball 83 with the taper at the end of passageway 81 occurs when passageway 85 communicates with the fluid supply side and passageway 84 communicates with the fluid return side.

Figure 8:
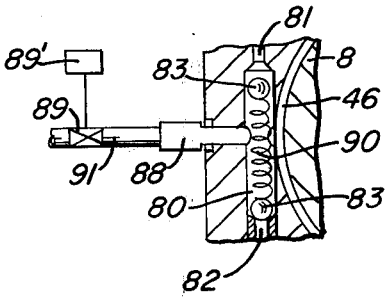
FIG. 8 is a cross sectional view similar to a portion of FIG. 6 of a modification of this invention.

One important feature of this invention resides in shifting the valve body 8 to provide a fluid coupling or bypass such that the rotation of the displacement set can be selectively discontinued while the supply of fluid is continued or a bypass for fluid displaced when output shaft 44 is externally driven and drives the displacement set so as to create a fluid pumping action by the displacement set. Output shaft 44 in certain installations, such as a wheel drive, can be rotated independently to back drive the displacement set. In forming the fluid opening between passageway 80 and chamber 48 the casing 6 has a through passageway 86 therein which is suitably sealed, FIG. 6, such as by a threaded fastener and gasket structure 87 as shown, to prevent the loss of fluid from passageway 80. When desired the passageway 86 can be connected to a suitable fitting 88, see FIG. 8, to a discharge line 91 having a suitable valve and valve control means 89 and 89' respectively for controlling the discharge of fluid from passageway 80. In addition a pair of valve balls 83 are located within passageway 80 and are maintained in axially spaced relationship by means of a suitable open spring 90 such as a helical spring. With such structure the balls 83 will still function as check valves to permit the valve 8 to be biased as previously described; however, upon discharging fluid from passageway 80 through fitting 88 and providing a higher volume fluid through discharge line 91 than is admitted to passageway 80 from either passageway 81 or 82 the fluid pressure will drop in passageway 80 and chamber 48 so that the valve 8 is no longer biased into engagement with valve plate 4. Consequently, the supply fluid will enter the interface between the valve plate 4 and the valve 8 to axially shift the valve 8 away from the valve plate 4.

Upon removal of the bias force upon the valve 8, the valve 8 shifts outwardly or away from the valve plate 4 placing the ports 64 and 68 cooperable with the ports 30 in valve plate 4 through ports 72 and 74 in open fluid communication with each other whereby, regardless of the direction of rotation of the displacement set, the supply fluid bypasses the valve plate 4 and the displacement set and flows directly to the return side. When the supply of fluid to the displacement set is discontinued the rotation of the displacement set and the conjoint rotation of valve 8 is discontinued. Rotation of the displacement set can be reinstituted at any time by closing the discharge line 91, either by hand or by the control 89', to repressurize the chamber 48 to the pressure of the supply fluid and shift valve 8 into engagement with valve plate 4. In this regard the area of the chamber 48 upon which the supply fluid acts must be sufficient, in conjunction with the pressure of the supply fluid, to overcome the reverse bias of the fluid between the valve 8 and the valve plate 4. In instances where the displacement set is driven by the shaft 44 the resultant orbital movement of the rotor 22, when the bias is removed from valve 8, displaces fluid from the displacement set into the space between the valve plate 4 and valve 8 so that the displaced fluid is not acting counter to the supply fluid.

Inasmuch as the supply of fluid to the displacement set, regardless of its direction of rotation, is controlled solely by the cooperation of the valve 8 with the valve plate 4 there is no necessity that the other portions of the housing of the device by pressurized. It is desirable, however, that the fluid pressure within the casing extension 10 be maintained at a positive pressure to provide lubrication of the bearings 12 by a supply fluid having lubricating capabilities such as lubricating hydraulic fluids. When such a supply fluid is to be utilized the casing 6 is provided with a pair of passageways 92 and 93 in fluid communication with the ports 64 and 68 respectively. Passageways 92 and 93 are connected by two parallel fluid passageways 45 and 47, respectively, to a passageway 94 which communicates through a passageway 95 to the interior of casing 6 at any suitable location for the purposes described herein. As shown, the inlet end of passageway 95 is located at the same side elevation of the reduced portion 57 of shaft 44 and the outlet end of passageway 95 is located intermediate passageway 94.

The junctures between passageways 92, 93 and passageways 45, 47 are each provided with a tapered seat flared openly towards the passageways 92, 93 which are cooperable with tapered ends 49 of valve assemblies 96, 97 in passageways 92, 93 respectively. Valve assemblies 96, 97 are preferably identical and are of any suitable construction to prevent the flow of supply fluid to passageway 94. For such purposes valve assemblies have suitable springs 53 which bias the tapered ends 49 of the valve assemblies 96, 97 into engagement with the tapered seats of passageways 45, 47 so that, regardless of which passageway 64 or 68 is the supply line, supply fluid cannot enter passageway 94 and pressurize the interior of casing 6 through passageway 95. In order to ensure that supply fluid cannot flow between passageways 92, 93 passageways 92, 93 are connected by a shuttle valve arrangement such as previously described with relation to FIG. 6. Accordingly like parts have been identified by the same reference numerals primed. Although such shuttle valve structures are identical in function they need not be identical in dimension.

Figure 7:
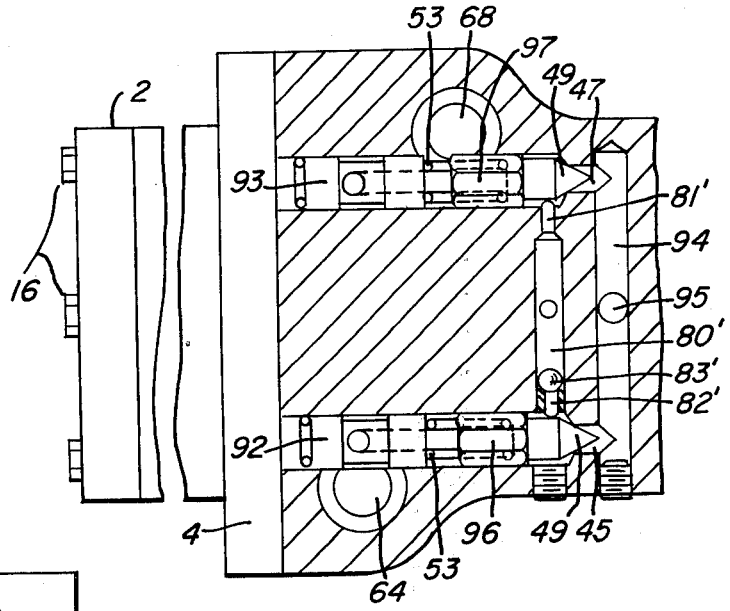
FIG. 7 is a partial side elevational view and a partial cross sectional view taken on a plane of the valve casing axially displaced from the section 4—4.
Figure 2:
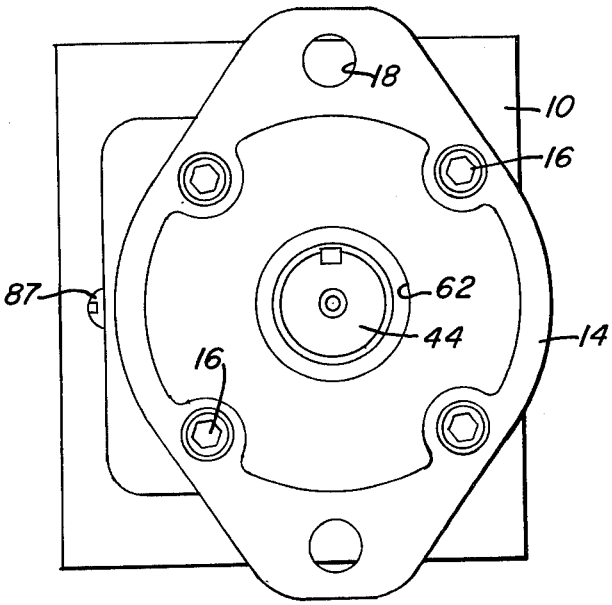
FIG. 2 is an end elevational view of the device as shown in FIG. 1.

Upon operation of the displacement set a flow of fluid occurs, due to the clearances inherent in a device of this type, into the interior of casing 6 which is utilized to lubricate the bearings 12. Such clearance fluid communicates via passageways 95 and 94 to the passageways 45, 47 and is effective upon the tapered ends 49 of the valve assemblies 96, 97. Shuttle ball 83' ensures that one of the valve assemblies 96, 97 is in fluid communication with the return fluid line. Accordingly, when such clearance fluid is at a pressure in passageways 45, 47 to overcome the bias of the spring 53 of the valve assembly 96 or 97 in communication with the return side flow will unseat such valve assembly and place passageways 94, 95 in fluid communication with the return side. By providing proper springs 53 the lubricating fluid pressure is preferably maintained at a pressure of 5 to 10 psi. As shown in FIG. 7 and in keeping with the prior description, passageway 64 is connected to the fluid return or discharge line. The positive lubrication system provided by the structure described with relation to FIG. 7 will operate in the reverse manner as described upon reversing the direction of the displacement set. Inasmuch as a positive pressure is provided within casing extension 10 a suitable sealing means 99 as is known is located between the shaft 44 and the opening 62 to maintain such positive pressure. Similarly suitable sealing means 3 as is known are provided between the shaft 44 and the opening 62, which is shown as stepped, to prevent contaminents from entering the device. Suitable O-ring seals 5 as are known are also located as shown between the plate 14 and casing extension 10 and between the casing extension 10 and casing 6 to prevent the loss of fluid from inside the device and the entry of contaminents from outside the device. Also a suitable dynamic O-ring or automatic piston ring type or equivalent seal 7 is provided between the chamber 48 and the end of the axial extent 42 to prevent fluid leakage from the chamber 48.

As has been described the present invention provides a unitary valve structure, valve 8, which contains all the fluid porting required, in cooperation with the stationary valve plate, to control all the critical timing function for the rotation of the rotor of the displacement set. Further since there is an interface between the valve and the valve plate this invention provides for inherent biasing of the valve into engagement with the valve plate; however, when advantageous such bias can readily be removed. With the fluid control being by a unitary valve the fluid pressure in the remainding portion of the housing can be selected as desired. Also, since displacement sets are known to be reversible this invention provides the above advantages regardless of the direction of rotation of the displacement set; however, if a single direction of rotation is desired, the manufacture of the device of this invention can be simplified to eliminate the unnecessary structure for controlling the pressure of the fluid in the chamber 41 and the bearings 12 and gear segments 54–56 for the direction of rotation not being utilized and the structure unnecessary to provide for biasing the valve 8 for the direction of rotation not being utilized.

The structure of this invention is well suited to employ any type of motive fluid such as compressed air, gasses and fluids mediums not necessarily having lubricating properties since the motive fluid is contained by the valve 8 and the housing 2. Obviously, lubricating fluids are preferably utilized; however, when nonlubricating fluids or gasses are utilized a separate supply of lubricant to bearings 12 and gear segments 54–56 may be employed or self lubricating bearings may be employed. The biasing of valve 8 into engagement with valve plate 4 provides for minimum abrasion therebetween; however, if desired, the face of valve 8 cooperable with valve plate 4 may be provided with suitable facing material to minimize frictional resistance dependent upon the medium employed to actuate the displacement set. Although not shown, a spring can be employed between the ring 60 and the end of the axial extent 42 of valve 8 to provide a positive bias to valve 8 at all times which spring is selected with relation to the forces acting upon valve 8. Such a spring ensures positive bias of valve 8 if a vacuum is encountered or the use of an automatic release mechanism is desired.

An important aspect of this invention is the fact that as different displacement sets as are known are employed, the advantages of this invention can be achieved by providing a valve 8 structure as is necessary to control the supply and discharge of fluid to the different displacement sets. Such different valve structures can readily be inserted within the same casing 6 to provide a wide range of power output devices. Thus, when a different displacement set is desired, it is only necessary to provide appropriate valves 8 and valve plates 4 which can be received in and secured to the casing 6. Inasmuch as displacement sets are well known, the invention herein has been described with relation to utilizing a known displacement set with a separate valve plate 4. In instances where the volume warrants special displacement sets incorporating the valve plate can be utilized such that a separate valve plate 4 would not be necessary.

Having described a preferred embodiment of this invention in accordance with the Patent Statutes and having set forth various modifications thereto, those skilled in the art will be cognizant of the fact that still other modifications can be made without departing from the spirit and scope of this invention. Accordingly, the following claims are to be construed as including modifications of the structures defined therein as would be known to those skilled in the relevant art.

What is claimed is:

1. A fluid actuated device comprising: a housing member having an elongated open ended bore extending axially inwardly from one end thereof, said housing member having an internal chamber spaced axially from the inner end of said bore with an interior portion of said housing member being located therebetween, said housing member having a laterally and axially inwardly facing surface thereon between axially extending portions of said bore, a rotary member closely rotatively received in said axial extending portions of said bore, said rotary member having a surface thereon spaced axially inwardly of said surface on said housing member to form a bias chamber therebetween, said interior portion having an intermediate opening extending therethrough between said chamber and said bore, an elongated means having one end formed to constitute in conjunction with said chamber a displacement set with said one end being movable through an orbital path, said elongated means having an intermediate portion extending through said intermediate opening and the other end thereof in driving engagement with said rotary member to rotate said rotary member, at least one of said members having fluid supply passageway means and fluid discharge passageway means adapted to be connected to a source of pressurized fluid and a fluid receiving means, respectively, said fluid supply passageway means and said fluid discharge passageway means each extending through said interior portion and at least an adjacent portion of said rotary member to control the supply and discharge of fluid to said displacement set and orbitably rotate said one end of said elongated means, and other passageway means in at least one of said members in fluid flow communication with said bias chamber and adapted to be in fluid flow communication with such a source of pressurized fluid to permit fluid from such a source to bias said rotary member into engagement with said interior portion.

2. A fluid actuated device as set forth in claim 1 wherein said other passageway means extends between said fluid supply passageway means and said bias chamber within said housing member.

3. A fluid actuated device as set forth in claim 1 wherein said other passageway means comprises an intermediate elongated portion in fluid flow communication with said bias chamber, said other passageway means having extents in fluid flow communication with the end portions of said elongated portion and said fluid supply passageway means and said fluid discharge passageway means, respectively, and means within said elongated extent responsive to the pressure of a supply fluid within said fluid supply passageway means to discontinue the fluid flow communication between said fluid discharge passageway means and said elongated portion.

4. A fluid actuated device as set forth in claim 1 wherein the area of said bias chamber extending transversely of the central longitudinal axis of said bore is of a magnitude to provide said bias on said rotary member throughout the range of pressures at which fluid is supplied to said fluid supply passageway means.

5. A fluid actuated device as set forth in claim 1 wherein said rotary member has a through bore extending axially of said housing having engageable means on the internal periphery thereof, and said elongated means having said other end thereof in driving engagement with said engageable means.

6. A fluid actuated device as set forth in claim 1 wherein the central axes of said open ended bore, said rotary member and said chamber are coaxial with each other and the longitudinally extending central axis of said housing.

7. A fluid actuated device as set forth in claim 1 wherein the engageable portions of said rotary member and said interior portion are planar surfaces.

8. A fluid actuated device as set forth in claim 1 wherein said housing member extends axially outwardly from said rotary member to form a bearing receiving chamber outwardly adjacent thereto, an elongated power output shaft rotatively driven by said rotary member and extending through and beyond said bearing receiving chamber, bearing means in said bearing receiving chamber to rotatively support said power output shaft, and further passageway means in said housing member in selective fluid flow communication with fluid discharge passageway means and said bearing retaining chamber for maintaining fluid therein at a selected pressure.

9. A fluid actuated device comprising: an elongated housing member having a pair of axially spaced chambers therein with an interior portion of said housing extending therebetween, said interior portion having an opening therein extending between central portions of adjacent axial ends of said chambers, a rotary member closely rotatively received within one of said chambers, an elongated means having one end formed to constitute in conjunction with the other of said chambers a displacement set with said one end being movable through an orbital path, said elongated means having an intermediate portion thereof extending through said opening and the other end thereof engageable with said rotary member to rotate said rotary member, at least one of said members having fluid supply passageway means and fluid discharge passageway means therein adapted to be connected to a source of pressurized fluid and a fluid receiving means, respectively, said fluid supply passageway means and said fluid discharge passageway means each extending through said interior portion and at least an adjacent portion of said rotary member, and said rotary member being selectively movable within said one chamber into engagement with said interior portion to control the supply and discharge of fluid to said displacement set and in spaced relationship to said interior portion to discontinue the supply and discharge of fluid to said displacement set.

10. A fluid actuated device as set forth in claim 9 wherein the engageable portions of said rotary member and said interior portion are planar surfaces.

11. A fluid actuated device as set forth in claim 9 wherein the rotative axis of said rotary member, the central axis of said housing and said other of said chambers are coincident.

12. A fluid actuated device as set forth in claim 9 wherein a portion of said fluid supply passageway means and a portion of said fluid discharge passageway means are in said housing and in constant fluid flow communication with said portions thereof, respectively, in said rotary member.

13. A fluid actuated device as set forth in claim 9 wherein said rotary member rotatively drives a power output shaft selectively coupled thereto.

14. A fluid actuated device as set forth in claim 9 wherein said housing member and said rotary member define a bias chamber therebetween for receiving a pressurized fluid therein, and said rotary member being selectively movable within said one chamber in response to the fluid pressure in said bias chamber.

15. A fluid actuated device as set forth in claim 14 having selectively operable means in fluid communication with said bias chamber to control the pressure of a fluid within said bias chamber.

* * * * *